US007975541B2

(12) United States Patent
Large et al.

(10) Patent No.: US 7,975,541 B2
(45) Date of Patent: Jul. 12, 2011

(54) FOLDING ULTRASONIC BOREHOLE IMAGING TOOL

(75) Inventors: Stuart Anthony Large, Weybridge Surrey (GB); Scott Ronald Kennedy, Calgary (GB); Richard Harvey Wood, London (GB)

(73) Assignee: General Electric Company, Schenectady, NY (US)

( * ) Notice: Subject to any disclaimer, the term of this patent is extended or adjusted under 35 U.S.C. 154(b) by 61 days.

(21) Appl. No.: 12/639,412

(22) Filed: Dec. 16, 2009

(65) Prior Publication Data

US 2011/0138903 A1 Jun. 16, 2011

(51) Int. Cl.
*E21B 47/01* (2006.01)
*E21B 17/10* (2006.01)

(52) U.S. Cl. ..... 73/152.57; 166/241.5

(58) Field of Classification Search ..... 73/152.57; 166/241.5

See application file for complete search history.

(56) References Cited

U.S. PATENT DOCUMENTS

| | | | | | |
|---|---|---|---|---|---|
| 3,555,689 | A | * | 1/1971 | Cubberly | 33/544.3 |
| 4,121,345 | A | * | 10/1978 | Roesner | 33/544.2 |
| RE31,607 | E | * | 6/1984 | Vogel et al. | 367/86 |
| 4,495,605 | A | * | 1/1985 | Desbrandes et al. | 367/33 |
| 4,619,322 | A | * | 10/1986 | Armell et al. | 166/241.5 |
| 4,780,857 | A | | 10/1988 | Lyle et al. | |
| 4,830,105 | A | * | 5/1989 | Petermann | 166/241.1 |
| 4,876,672 | A | * | 10/1989 | Petermann et al. | 367/35 |
| 4,912,683 | A | * | 3/1990 | Katahara et al. | 367/25 |
| 5,044,462 | A | | 9/1991 | Maki, Jr. | |
| 5,358,039 | A | * | 10/1994 | Fordham | 166/241.1 |
| 5,531,112 | A | * | 7/1996 | Young et al. | 73/152.02 |
| 5,574,263 | A | * | 11/1996 | Roesner | 181/102 |
| 5,661,237 | A | * | 8/1997 | Dussan et al. | 73/152.18 |
| 5,996,711 | A | | 12/1999 | Ohmer | |
| 6,904,818 | B2 | * | 6/2005 | Harthorn et al. | 73/865.8 |
| 7,698,937 | B2 | * | 4/2010 | Neidhardt | 73/152.57 |
| 7,784,339 | B2 | * | 8/2010 | Cook et al. | 73/152.57 |
| 2003/0188589 | A1 | * | 10/2003 | Harthorn et al. | 73/865.8 |
| 2006/0067162 | A1 | | 3/2006 | Blankinship | |
| 2006/0262643 | A1 | | 11/2006 | Blankinship | |

* cited by examiner

*Primary Examiner* — John Fitzgerald
(74) *Attorney, Agent, or Firm* — Pearne & Gordon LLP

(57) ABSTRACT

A borehole logging tool includes a housing oriented along a longitudinal axis, and a centralizer assembly that positions the housing substantially at the center of the borehole. In one example, the centralizer assembly includes a plurality of centralizer arms radially extendable outward from the longitudinal axis. The borehole logging tool further includes a scanning head that rotates a plurality of scanning sensors axially within the borehole about the longitudinal axis. The scanning head further includes a plurality of linkage arms coupled to the plurality of scanning sensors such that the scanning sensors are radially extendable outward from the longitudinal axis. The borehole logging tool further includes an extension assembly adapted to substantially concurrently control the radial extension of the centralizer arms and the plurality of sensors.

20 Claims, 3 Drawing Sheets

FOLDING ULTRASONIC BOREHOLE IMAGING TOOL

BACKGROUND OF THE INVENTION

1. Field of the Invention

The invention relates to downhole tools, and specifically relates to a borehole logging tool operable over a range of borehole sizes.

2. Discussion of Prior Art

Well boreholes are typically drilled in earth formations to produce fluids from one or more of the penetrated formations. The fluids include water, and hydrocarbons such as oil and gas. Well boreholes are also drilled in earth formations to dispose waste fluids in selected formations penetrated by the borehole. The boreholes are typically lined with tubular structure commonly referred to as casing. Casing is typically steel, although other metals and composites such as fiberglass can be used. Grouting material, such as cement, fills the casing-borehole annulus to hydraulically isolate various formations penetrated by the borehole and casing.

The wall of the casing can be thinned. Corrosion can occur both inside and outside of the casing. Mechanical wear from pump rods and the like can wear the casing from within. Casing wear can affect the casing's ability to provide mechanical strength for the borehole. In addition or alternatively, various grouting problems can compromise hydraulic isolation of the casing, such as improper bonding, incomplete filling of the casing-cement annulus, and/or casing corrosion/wear.

Measures of one or more of the borehole parameters of interest are useful over the life of the borehole, extending from the time that the borehole is drilled until the time of abandonment. It is therefore economically and operationally desirable to operate equipment for measuring various borehole parameters using a variety of borehole survey or "logging" systems. Such logging systems can include multiconductor logging cable, single conductor logging cable, etc.

Borehole environments are typically harsh in temperature, pressure and ruggosity, and can adversely affect the response of any logging system operating therein. More specifically, measures of the borehole parameters can be adversely affected by harsh borehole conditions. Since changes in borehole temperature and pressure are typically not predictable, continuous and real time system calibration within the borehole is highly desirable. Generally, downhole tools are lowered through the inner diameter of the casing tubing for various purposes. Some tools are provided with power through electrical conductors while other tools are battery-powered. Downhole tools may include a number of modules with lengths up to thirty feet, or even more.

Boreholes are drilled and cased over a wide range of diameters. The casing inside diameter can also vary due to corrosion, wear, or other obstructions. It can be desirable for a borehole tool to operate over a range of borehole diameters.

BRIEF DESCRIPTION OF THE INVENTION

The following summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

One aspect of the invention provides a borehole logging tool, including a housing oriented along a longitudinal axis and a centralizer assembly that positions the housing substantially at the center of the borehole. The centralizer assembly includes a first slider member and a plurality of centralizer arms coupled thereto. The first slider member is slidable along the longitudinal axis to selectively control a radial extension of the plurality of centralizer arms. The borehole logging tool further includes a scanning head that rotates a plurality of scanning sensors axially within the borehole about the longitudinal axis, and further includes a second slider member and a plurality of linkage arms coupling the second slider member to the plurality of scanning sensors. The second slider member is slidable along the longitudinal axis to selectively control a radial extension of the plurality of sensors.

Another aspect of the invention provides a borehole logging tool, including a housing oriented along a longitudinal axis, and a centralizer assembly that positions the housing substantially at the center of the borehole. The centralizer assembly includes a plurality of centralizer arms radially extendable outward from the longitudinal axis at a first diameter. The borehole logging tool further includes a scanning head that rotates a plurality of scanning sensors axially within the borehole about the longitudinal axis. The scanning head further includes a plurality of linkage arms coupled to the plurality of scanning sensors such that the scanning sensors are radially extendable outward from the longitudinal axis at a second diameter. The borehole logging tool further includes an extension assembly adapted to substantially concurrently control the radial extension of the centralizer arms and the plurality of sensors.

Another aspect of the invention provides a borehole logging tool, including a centralizer assembly that positions a housing substantially at the center of the borehole, and further including a first slider member and a plurality of centralizer arms coupled thereto. The first slider member is slidable along a longitudinal axis to selectively control a radial extension of the plurality of centralizer arms. The borehole logging tool further includes a scanning head that rotates a plurality of scanning sensors axially within the borehole about the longitudinal axis. The scanning head further includes a second slider member coupled to the plurality of scanning sensors, the second slider member being slidable along the longitudinal axis to selectively control a radial extension of the plurality of sensors. The borehole logging tool further includes a main shaft coupled to both of the first and second slider members and linearly movable along the longitudinal axis to drive sliding movement of both of the first and second slider members to simultaneously control the radial extension of the centralizer arms and the plurality of sensors.

BRIEF DESCRIPTION OF THE DRAWINGS

The foregoing and other aspects of the invention will become apparent to those skilled in the art to which the invention relates upon reading the following description with reference to the accompanying drawings, in which.

DETAILED DESCRIPTION OF THE INVENTION

Figure 1:
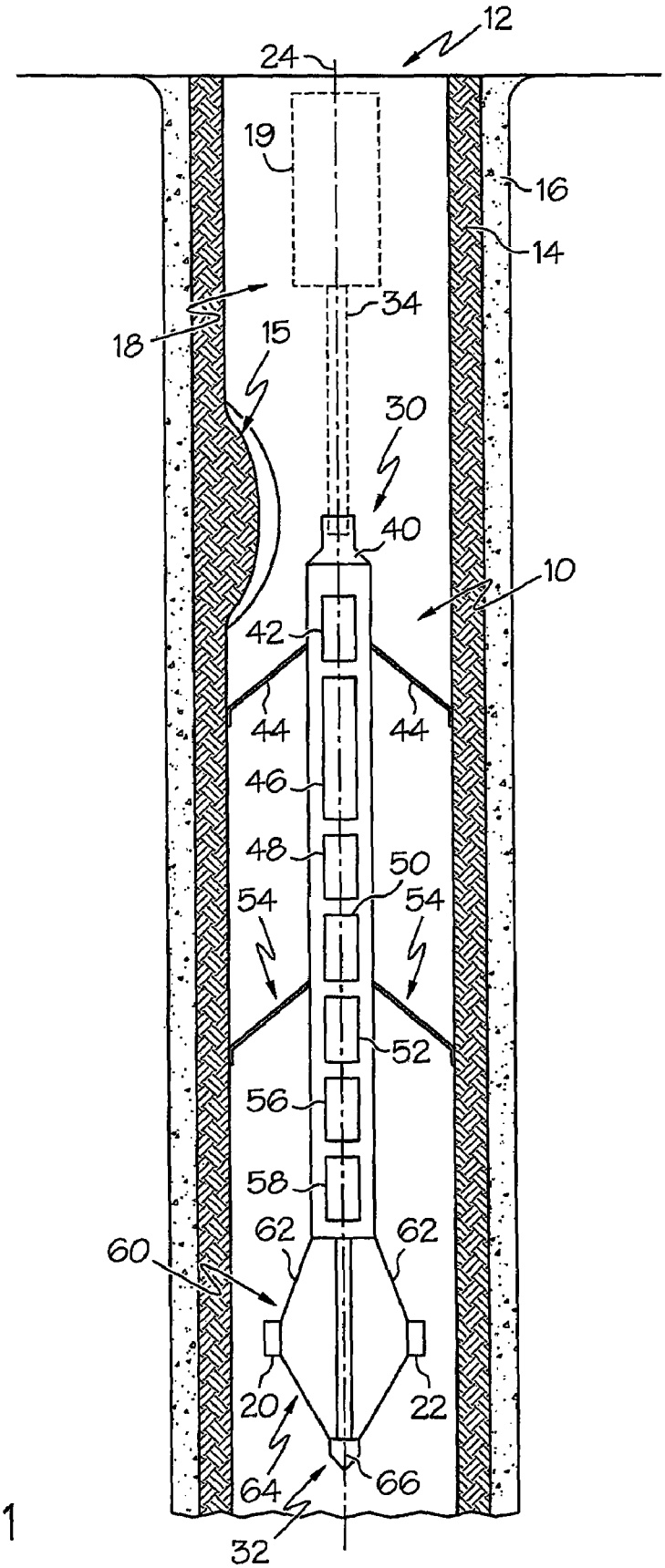
FIG. 1 is a side view of an example borehole logging tool within an example borehole.

Example embodiments that incorporate one or more aspects of the invention are described and illustrated in the drawings. These illustrated examples are not intended to be a limitation on the invention. For example, one or more aspects of the invention can be utilized in other embodiments and even other types of devices. Moreover, certain terminology is used herein for convenience only and is not to be taken as a limitation on the invention. Still further, in the drawings, the same reference numerals are employed for designating the same elements.

For the purposes of this disclosure, the term "tool" is very generic and may be applied to any device sent downhole to perform any operation. Particularly, a downhole tool can be used to describe a variety of devices and implements to perform a measurement, service, or task, including, but not limited to, pipe recovery, formation evaluation, directional measurement, and/or workover.

Turning to FIG. 1, an example embodiment of a borehole logging tool 10 is illustrated. The borehole logging tool 10 is adapted for use in a borehole 12 in the earth that can be lined with a tubular casing 14 secured with various grouting materials 16, such as cement or the like. The borehole logging tool 10 can be adapted to be part of a toolstring 18 including one or more other downhole tools 19 connected generally by couplers or cables, which can include power and/or data cables. Where a portion of the borehole logging tool 10 is adapted to rotate within the borehole 12, the borehole logging tool 10 can be the terminal tool of the toolstring 18, though could also be arranged variously within the toolstring 18 with appropriate supporting structure. It is contemplated that various other structures can also be provided as part of the toolstring 18.

The toolstring 18 is generally deployed towards the center of the casing 14, such as along a central axis 24 of the casing 14. However, for various reasons known by one of skill in the art, it is often desirable to locate sensors 20, 22, such as ultrasonic transducers, at various distances offset from the central axis 24. For example, as shown, the sensors 20, 22 of the borehole logging tool 10 can be positioned adjacent the wall of the casing 14 (i.e., disposed with a relatively greater radial offset relative to the central axis 24). The sensors 20, 22 can also be positioned away from the wall of the casing 14 (i.e., disposed with a relatively lesser radial offset relative to the central axis 24) to accommodate changes in the borehole 12 diameter, such as by a restriction 15 or the like. Thus, the tool 10 can avoid being stuck on the restriction 15, which can otherwise involve subsequent removal costs, expensive rig time, and/or environmental concerns. The borehole logging tool 10 can be selectively adjusted to provide the desired offset distances for the sensors, as will be discussed herein.

The borehole logging tool 10 can include a first end 30, and a second end 32 disposed deeper within the borehole 12. As used herein, the terms "first" and "second" are used only for convenience. The first and second ends 30, 32 can each include coupling structure (e.g., field joints) adapted to couple the borehole logging tool 10 with another joint, downhole tool, etc. The coupling structure can include cable structure and/or male or female coupling structure, such as a keyed and/or threaded connections (not shown). Such structure can include various configurations, including various other coupling structures known to one of skill in the art.

In addition, the borehole logging tool 10 can include at least one electrical coupler. For example, at least one electrical coupler 34 can be provided to one of the ends 30, 32 for communicating electrical current to the tool 10, and/or to another tool in the toolstring 18. The electrical coupler(s) 34 can be configured to be coupled to various corresponding electrical and/or mechanical structure(s) for transferring the electrical current. The electrical current can provide various digital and/or analog signals, such as electrical power, communication, etc. between the various downhole tools, couplers, and control structure (not shown) provided outside of the borehole 12. In addition or alternatively, various other signals for providing power, communication, etc. can be provided by various other structure, including optical signals (e.g., via fiber optic cable, etc.), wireless signals (e.g., via electromagnetic transmission, etc.), or the like. Any or all of the signal structure, such as wire(s), can be protected, shielded, etc. in various manners, such as with sealed flexible tubing or the like. Coupling structure at either of the ends 30, 32 can also include various sealing structure or the like.

One example construction of a borehole logging tool 10 will now be discussed. It is to be understood that the borehole logging tool 10 is illustrated schematically in FIG. 1 for clarity. More or less elements can be included, may be arranged variously, may have differing geometries and/or sizes, etc.

Starting from the first end 30 of the tool and working downwards, the first block shown in the diagram is a tool connection 40 for coupling to the remainder of the toolstring 18. The tool connection 40 can include the coupling structure discussed herein, and/or electrical coupler(s) 34, etc. Because of the relatively high power demands of the spinning and folding motors (or even various other types of motors or actuators, such as hydraulic or pneumatic motors or actuators, etc.) utilized in the borehole logging tool 10, a plurality of high voltage power supplies may be utilized, such as in a dual connection configuration or the like. For example, because of the multiple elements for operating this borehole logging tool 10, two distinct power sources can be used. The first source can be a communication bus that would also be used to deliver low voltage power to electronics of the multiple sensing elements. The second power source could be a high voltage feed-through from the wireline using a dual connection configuration to power the spinning and/or actuation motors.

The second block illustrates a swivel 42 that would allow the tool 10 some rotation in the borehole 12, such as without twisting the remainder of the toolstring 18. For example, regardless of the gripping ability of any centralizers that can be used to stabilize the tool 10, it may still gradually rotate in the borehole 12 due to torque transfer from the rotating section below. To at least partially compensate for this effect, the swivel 42 can be equipped with an encoder that could allow the tool 10 to rotate freely from the rest of the toolstring 18 while the encoder would record the relative position of the borehole logging tool 10 relative to the other tools (not shown) in the toolstring 18. Thus, the data from the borehole logging tool 10 can be registered with data from other tools in the above toolstring 18, based upon the position encoding information.

The third item illustrates an upper centralizer 44 which can include a plurality of extendable centralizer arms. The upper centralizer 44 can be used to hold the borehole logging tool 10 generally in the center of the borehole 12 (i.e., along central axis 24) so that the spinning sensor section below does not collide with the wall of the casing 14. The upper centralizer 44 can also anchor the tool in the casing 14 by means of a gripping feature (not shown), which can be disposed on the ends of one or more centralizer arms, so as to inhibit, such as prevent, the tool 10 from spinning due to a reactive force of the rotating arms below by being in contact with the surrounding casing 14 and transferring the force thereto. The arms of the upper centralizer 44 can also act together with the lower centralizer arms to inhibit, such as prevent, the tool 10 from pivoting relative to the central axis 24 of the borehole 12. The arms of the upper centralizer 44 can be spring biased outwards (i.e., away from a longitudinal axis of the tool) towards the casing 14, and may be manually controlled or even self-controlling.

The fourth block is an electronics housing 46 which could contain some or all of the electronics utilized for operation of the borehole logging tool 10. For example, the electronics can include low voltage power supplies for electronics and/or sensors, power supplies for the motors, motor control logic, position sensor drivers (i.e., rotation orientation, folding arm position, swivel position, etc.), communication components, analysis components, ultrasonic drivers, receivers, transformers, amplifiers, data telemetry, data management, and/or data processing components. Also, for development in particular, memory can be included in the electronics section for more complete data recording and testing. The large amount of data, the nature of the signals and/or the frequencies involved can make correct data processing an intensive task. The incoming signals may have frequencies centered at approximately 300-500 kHz which means that electronics and/or software should allow for accurate and efficient digitization and processing of the resulting large amount of data that is to be performed.

In addition or alternatively, various positional values can be monitored by the electronics housing 46 so as to provide accurate data output. For example, sensing information can include the position of the sensor head 60 with respect to the tool central axis 24, the rotational orientation of the sensor head 60 with respect to the tool body, and/or the rotational orientation of the tool 10 with respect to the rest of the toolstring 18.

The fifth block can illustrate a reference cell 48. For example, the reference cell 48 can be a sensor assembly that is mounted opposite a solid piece of housing at a fixed spacing and exposed to the wellbore fluid. This sensor could be driven periodically in the exact manner of the measurement sensors on the spinning arms below and due to the fixed spacing the well fluid acoustic properties can be determined and recorded for correcting the values obtained from the main sensors. In another example, the reference cell 48 can have a configuration described in U.S. patent application US2006/0262643, which is incorporated herein by reference.

The sixth block can illustrate a mechanical pressure compensation section 50 used to pressure balance the motors, bearings, electrical couplings and possibly sensors in the tool to the borehole pressure. The pressure compensation section 50 can be located above the motors and actuation portions of the borehole logging tool 10.

The seventh block can illustrate a motor 52, such as a brushless DC, that can be adapted to provide linear motion to fold and extend the arms of the bottom centralizer assembly 54. For example, the motor 52 can be used to actuate a linear drive system, and can include a gearbox or the like. In addition or alternatively, it is contemplated that various types of actuators or motors, such as hydraulic or pneumatic actuators, motors, or the like (not shown), can also be used to provide linear motion.

Next, the bottom centralizer assembly 54 can be used to centralize the borehole logging tool 10 within the borehole (i.e., generally along the central axis 24) and inhibit, such as prevent, the tool 10 it from rotating and/or pivoting in the borehole 12. The centralizer assembly 54 can include a plurality of extendable arms for engagement with the wall of the casing 14. The arms of the centralizer assembly 54 can also anchor the tool 10 in the casing 14 by means of a gripping feature (not shown). The centralizer assembly 54 can also be linked to the folding arms of the spinning sensor head 60 below in such a manner as to serve as a caliper and standoff. For example, this feature could maintain a desired spacing between the casing 14 and the spinning sensor head 60 such that if a restriction 15 was encountered as the tool 10 was pulled upwards in the borehole 12, the centralizer assembly 54 would fold the spinning sensor head 60 inwards and away from any potential collision. The centralizer assembly 54 can include a position sensor for the arms.

Next, the ninth block can illustrate a second motor 56, such as a brushless DC motor, capable of spinning the fully extended arms of the spinning sensor head 60 against the resistive drag of the borehole fluid. Thus, the motor 56 can be a relatively high power and high torque motor that may include a suitable gearbox. The motor 56 can further include an encoder for recording rotational position of the motor 56 and driven components. In addition or alternatively, it is contemplated that various types actuators or motors, such as hydraulic or pneumatic actuators, motors, or the like (not shown), can also be used to provide rotational motion.

The tenth block can illustrate a rotary electrical coupling 58 or slip ring to provide for the transition between the upper stationary tool housing and the lower rotating components below. The rotary electrical coupling 58 is adapted to communicate electrical current between the plurality of sensors 20, 22 and the at least one electrical coupler 34 or the electronics 46, while the sensor head 60 is rotating. The rotary electrical coupling 58 can be mechanical and/or inductive. A plurality of rotary electrical coupling 58, such as one for each of the sensors, could be utilized. For example, the rotary electrical coupling 58 can have a relatively high bandwidth of a few MHz, or even more, due to the nature of the transmitted and reflected signals. The rotary electrical coupling 58 can also have low cross-talk between connections, be resistant to wear due to the requirement of 10,000 to 20,000 revolutions per logging job, be able to withstand the high temperature (e.g., greater than about 150 degrees Centigrade) and high pressure (e.g., greater than about 15,000 PSI) that the tool 10 operates in, and/or fit within the geometry of the tool 10 housing. Other operating conditions are also contemplated.

In one example, the rotary electrical coupling 58 can be a mechanical device, such as from IEC Corporation (TBVS-HT-0.375), that is rated for temperature and pressure, has 6 connections, has suitable high bandwidth requirements and has a lifetime of ~120-200×10^6 rotations. In another example, the rotary electrical coupling 58 can be an inductive coupling. For example, the inductive coupling can utilize approximately 1:1 turns ratio for transmission and reception of the signal, though various other designs are contemplated. This type of coupling provides flexibility in dimensions, has favorable high frequency response, and is a non-contact device that may utilize little maintenance to provide an increased lifetime. Structure and/or data analysis can be provided to boost efficiency and/or reduce, such as minimize, cross-talk between separate couplings.

Next, the spinning sensor head 60 can include a plurality of sensors 20, 22 that are provided for emitting signals and collecting return signals for logging data information about the casing 14. Various numbers of sensors 20, 22 can be utilized. Each of the sensors 20, 22 can be coupled to wiring arms 62 for providing power and data transmission. As the fluid drag on the wiring arms 62 is directly related to their cross section, the wiring arms 62 can be provided with a reduced cross section. Also, because the wiring arms 62 will be exposed to the borehole fluid may be damaged, they can be both electrically and mechanically shielded.

The sensors 20, 22 can include various types of sensors that may provide one or two-way signal interaction (i.e., transmitters, receivers, or transceivers). In one example, the sensors 20, 22 can be ultrasonic transducers, such as a 500 kHz PZT Navy II constructed as a piezoelectric circular disc and configured as transceivers. The sensors 20, 22 can be unidirectional to limit, such as minimize, backward propagating wavefronts that could reflect and interfere with the measurements. To create a desired warefront, the sensors 20, 22 can include various beamshaping, reflective layering and/or absorption features.

In addition to power and force implications, the vertical resolution is dependent on the spin rate of the sensor head 60. The maximum vertical spacing that is covered before a sensor 20, 22 of the sensor head 60 makes a repeat pass of the borehole is defined as the vertical resolution and is a function of both the spin rate and the logging speed. As the tool 10 is pulled faster up the borehole 12, the sensor head 60 must spin faster to accommodate a given vertical resolution. In the shown configuration, two sensors 20, 22 are provided opposite each other, though various numbers of sensors can be provided, which can slow the rotational speed used to collect data. For example, a standard vertical resolution of 3" may be possible to spin a two sensor tool with acceptable power consumption and fluid turbulence while maintaining a vertical logging speed of about 30 ft/min.

The spinning sensor head 60 can be coupled to a folding assembly 64 adapted to selectively control a radial extension of the sensors 20, 22. In one example, the folding assembly 64 can operate to control radial extension of the sensors 20, 22 from a diameter of about 2 inches out to at least about 10 inches, so as to be operable within various casing sizes. The folding assembly 64 can be linked to the bottom centralizer assembly 54 via a dampener. The bottom of the tool 10 (i.e., second end 32) can include a terminal end 66, such as a nose cone or even coupling structure for connection to another tool or the like.

Figure 2:
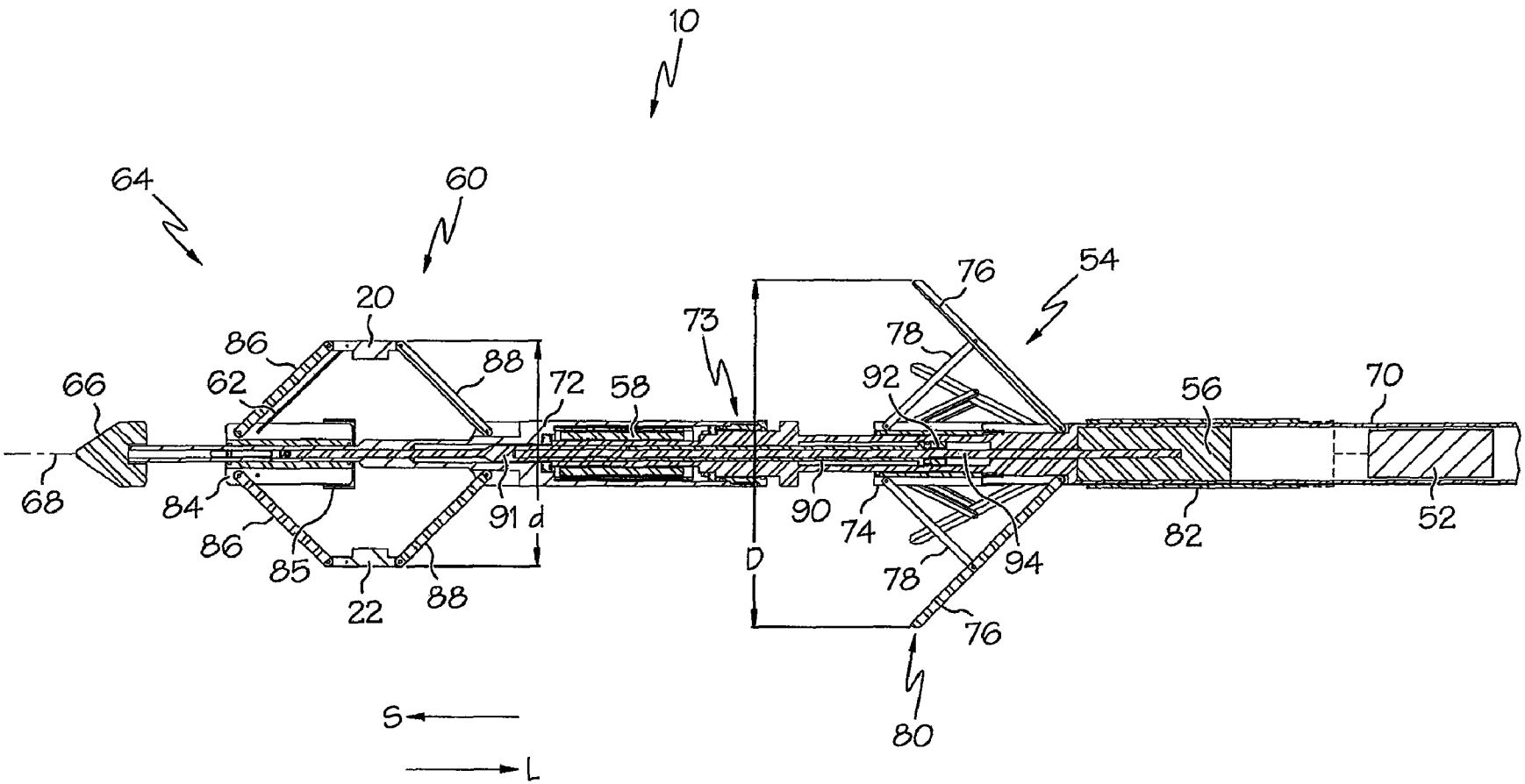
FIG. 2 is a side sectional view of the example borehole logging tool of FIG. 1 illustrated in a first example position.
Figure 3:
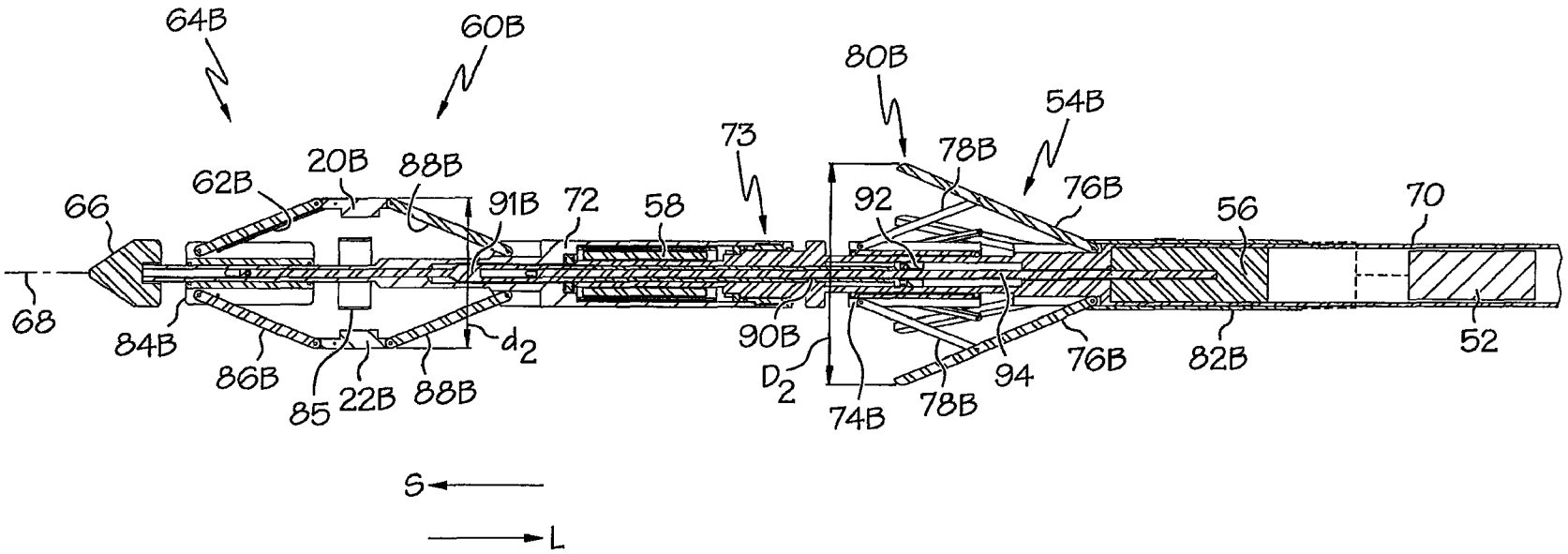
FIG. 3 is similar to FIG. 2, but shows the example borehole logging tool in a second example position.

Turning now to FIGS. 2-3, the borehole logging tool 10 will be described in further detail and illustrated in two example positions. When logging a well, it can be desirable to position the individual sensors 20, 22 at various radial offsets relative to the central axis 24 of the borehole 12 so as to be able to operate over a range of borehole diameters. For convenience, the radial offset of each sensor 20, 22, as described herein, will be taken relative to the longitudinal axis 68, which can also be the centerline, of the tool 10, which can be coaxial to the central axis 24 of the borehole 12. Still, it is to be understood that the radial offset can be taken with reference to various other portions of the borehole logging tool 10. Also, for convenience, the reference numbers in FIG. 3 utilize the letter "B" to denote the same element in a different position relative to FIG. 2.

The borehole logging tool 10 includes a housing oriented along the longitudinal axis 68 (i.e., centerline) of the tool 10. The housing can include an upper housing portion 70 that generally does not rotate, and a lower housing portion 72 that is intended to rotate together with the sensor head 60. Various components can be disposed within and/or between the upper and/or lower housing portions 70, 72, such as various rotational supports 73 (e.g., bearings, bushings), seals, mechanical and/or electrical couplings, sensors, etc. The borehole logging tool 10 further includes a centralizer assembly 54 (i.e., the bottom centralizer assembly) that positions the housing portions 70, 72 substantially at the center of the borehole 12 (i.e., along the central axis 24). The centralizer assembly 54 includes a first slider member 74 and a plurality of centralizer arms 76 coupled thereto. The centralizer arms 76 can be directly or indirectly pivotally coupled to the first slider member 74, such as by control arms 78 or the like. The first slider member 74 is slidable in a direction along the longitudinal axis to selectively control a radial extension of the plurality of centralizer arms 76 relative to the longitudinal axis 68 of the tool 10. At least a portion of the centralizer arms 76, such as all, can include a grip portion 80 adapted to grip an interior surface (i.e., the casing wall) of the borehole 12.

The plurality of centralizer arms 76 are radially extendable outward from the longitudinal axis 68 (i.e., centerline) to a diameter D. In one example, all of the centralizer arms 76 are extendable to the diameter D, though some may be extendable to another diameter. In the shown example, a plurality of centralizer arms 76 are generally equally spaced in a radial pattern around the tool 10, and as a result the term "diameter" is used for convenience. Still, various numbers of centralizer arms 76 can be arranged variously. The first slider member 74 is slidable along the longitudinal axis 68 of the tool 10, relative to the upper housing portion 70, to selectively control the radial extension of the plurality of centralizer arms 76. For example, because of the pivoting connection between the first slider member 74 and the control arms 78, as well as the pivoting connection between the control arms 78 and the plurality of centralizer arms 76, sliding movement of the first slider member 74 will either extend or retract the radial extension of the centralizer arms 76. For example, sliding movement of the first slider member 74 along the direction of arrow S will relatively reduce the diameter D of the centralizer arms 76, while sliding movement of the first slider member 74 along the direction of arrow L will relatively increase the diameter D.

The radial extension of the plurality of centralizer arms 76 can be controlled variously. In one example, the motor 52 can be adapted to provide linear movement to drive the first slider member 74. In another example, some or all of the centralizer arms 76 can be spring biased radially outwards (i.e., away from a longitudinal axis 68 of the tool 10) towards the casing 14 and a maximum diameter, and may be manually controlled or even self-controlling. The motor 52 can then be operated to counteract the spring-biasing to retract the plurality of centralizer arms 76. In one example, a control sleeve 82 can be provided around an exterior portion of the upper housing portion 70 and can be directly or indirectly coupled to the motor 52. The control sleeve 82 can be keyed for sliding movement along the upper housing portion 70, and may include a tapered geometry for engagement with the centralizer arms 76. Thus, the motor 52 can selectively move the control sleeve 82, relative to the upper housing portion 70, along the directions of arrows S or L. Upon moving towards the direction of arrow S, the control sleeve 82 can contact and/or surround the centralizer arms 76 to drive them radially inwards, against the spring biasing force, to a relatively lesser diameter D. Further movement of the control sleeve 82 along the direction of arrow S can result in an even lesser diameter D, down to a predetermined minimum diameter. Movement of the centralizer arms 76, such as via the motor 52, can be remotely controlled via the electrical coupler 34 or electronics housing 46, or may even be controlled autonomously by the electronics housing 46.

The borehole logging tool 10 further includes the sensor head 60 that rotates the plurality of sensors 20, 22 axially within the borehole 12 about the longitudinal axis 68. As such, the sensors 20, 22 may be considered to be scanning sensors. As discussed previously, it can be beneficial to position the sensors 20, 22 at different distances relative to the wall of the casing 14. Thus, the tool 10 can include structure to extend the sensors 20, 22 radially outward from the longitudinal axis 68. In one example, the sensor head 60 can include a folding assembly 64 that can include a second slider member 84, and plurality of linkage arms 86, 88 coupling the second slider member 84 to the plurality of scanning sensors 20, 22.

The second slider member 84 is slidable along the longitudinal axis 68 of the tool 10, relative to the lower housing portion 72, to selectively control the radial extension of the plurality of sensors 20, 22. The plurality of linkage arms can include a first set of linkage arms 86 pivotally coupled to the second slider member 84 and movable therewith, and a second set of linkage arms 88 pivotally coupled to the lower housing portion 72. For example, because the first set of linkage arms 86 are movable together with the second slider member 84 along the direction of arrows S or L, and the second set of linkage arms 88 coupled to the lower housing portion 72 and fixed relative to the arrows S or L, sliding movement of the second slider member 84 will either extend or retract the radial extension of the sensors 20, 22. Thus, sliding movement of the second slider member 84 along the direction of arrow S will relatively reduce the diameter d of the sensors 20, 22, while sliding movement of the second slider member 84 along the direction of arrow L will relatively increase the diameter d. Sliding motion of the second slider member 84 may be limited by the terminal end 66 and/or a stop 85, which may also limit radial extension of the sensors 20, 22.

The borehole logging tool 10 further includes an extension assembly adapted to substantially concurrently control the radial extension of the centralizer arms 76 and the plurality of sensors 20, 22. In one example, the extension assembly can include the first and second slider members 74, 84, and can further include a hollow main shaft 90 coupled to both of the first and second slider members 74, 84. The main shaft 90 can be movable relative to either or both of the upper and lower housing portions 70, 72 along the longitudinal axis 68.

For example, movement of the main shaft 90 along the longitudinal axis 68 couples sliding movement of both of the first and second slider members 74, 84 so as to substantially concurrently control the radial extension of the centralizer arms 76 and the plurality of sensors 20, 22. As a result, the centralizer arms 76 can be linked to the sensors 20, 22 such that changes in the diameter D of the centralizer arms 76 can result in changes in the diameter d of the sensors 20, 22.

In one example, the main shaft 90 can be centrally located along the longitudinal axis 68, and be coupled to each of the first and second slider members 74, 84 by a pinned connection or the like. As a result, a force is applied by the motor 52 upon the control sleeve 82 that drives the centralizer arms 76 generally inwards and drives the first slider member 74. That force applied by the motor 52 is then transferred, via the main shaft 90, to the second slider member 84 for substantially concurrently driving the radial extension of the plurality of sensors 20, 22 inwards. For example, FIG. 3 illustrates the centralizer arms 76B and sensors 20B, 22B having been moved radially inwards due to movement of the first and second slider members 74B, 84B generally along the direction of arrow S. As shown in FIG. 3, the diameters $D_2$, $d_2$ of the centralizer arms 76B and the sensors 20B, 22B, respectively, have been reduced (i.e., moved radially inwardly). Similarly, when reducing in diameter as shown in FIG. 2, the spring biasing force that acts to drive the centralizer arms 76 generally outward is also transferred by the main shaft 90 to the sensors 20, 22, via the first and second slider members 74, 84, for a similar outward movement (as shown in FIG. 2).

In a further example, a damper 92 can be disposed between the centralizer arms 76 and the plurality of sensors 20, 22. The damper 92 can be disposed between the first slider member 74 and the main shaft 90, or can also be disposed between the second slider member 84 and the main shaft 90 or various other locations. The damper 92 can be adapted to inhibit, such as prevent, quick or shocking movements of the sensors 20, 22 despite such quick or shocking movements of the centralizer arms 76. In various examples, the damper 92 can be a spring damper, piston damper, magnetic damper, fluid damper, or the like coupled to the first slider member 74. Thus, longitudinal movement of the first slider member 74 can compress the spring such that movement of the sensors 20, 22 is delayed until the spring is fully compressed. As a result, the centralizer arms 76 can be moved before the sensors 20, 22, and any quick or shocking movements of the centralizer arms 76 can be absorbed by the spring. It is to be understood that the substantially concurrent movement of the centralizer arms 76 and the sensors 20, 22 can include the time delay provided by the damper 92.

In addition or alternatively, the radial extension diameters of the centralizer arms 76 and the plurality of sensors 20, 22 can be related by a predetermined amount. Thus, for example, the centralizer arms 76 can be maintained at a relatively greater diameter D as compared to the diameter d of the sensors 20, 22 to inhibit, such as prevent, contact between the rotating sensor head 60 and the wall of the casing 14. In one example, the plurality of centralizer arms 76 can be radially extendable at a first diameter D and the plurality of sensors 20, 22 can be radially extendable at a second diameter d, and the second diameter d can be less than the first diameter D based on at least one of predetermined distance and a predetermined ratio. In a first example, the first diameter D of the centralizer arms 76 can be greater than the second diameter d of the sensors 20, 22 by a predetermined distance, such as about ½", 1", or other value. Thus, when the centralizer arms 76 are in contact with the wall of the casing 14, the sensors 20, 22 can be assured to be spaced a predetermined distance from the wall of the casing 14 by about ¼", ½", or other value. In a second example, the first diameter D of the centralizer arms 76 can be greater than the second diameter d of the sensors 20, 22 by a predetermined ratio, such as by about 10%, 25%, or other ratio. Thus, when the centralizer arms 76 are in contact with the wall of the casing 14, the sensors 20, 22 can be assured to be spaced away from the wall of the casing 14 by a predetermined ratio of about 5%, 12.5%, or other ratio of the diameter D.

In addition or alternatively, the borehole logging tool 10 can further include a drive shaft 94 rotatable together with the sensor head 60. The drive shaft 94 can be coupled to and driven by the motor 56 to drive rotation of the sensor head 60. The drive shaft can be arranged in a concentric relationship with the main shaft 90. Thus, the two concentric shafts can be provided for transferring the spinning action of the sensor head 60 (i.e., via the drive shaft 94), while the other shaft (i.e., the main shaft 90) is used to actuate the folding motion of the sensors 20, 22. In one example, the drive shaft 94 can have a relatively lesser diameter and be telescopically received within the hollow main shaft 90 having a relatively greater diameter.

In another example, so as to permit spinning of the sensor head 60 while also actuating the folding motion of the sensors 20, 22, the drive shaft 94 can be coupled to the main shaft 90 by a pinned connection. For example, the drive shaft 94 can include a pin that slides longitudinally in a slot of the main shaft 90, though various other constructions are also contemplated. In another example, so as also to permit spinning of the sensor head 60 while also actuating the folding motion of the sensors 20, 22, the main shaft 90 can be coupled to the first slider member 74 by a thrust bearing or the like. Thus, the lower housing portion 72 can be free to rotate with the sensor head 60 and second slider member 84, while the upper housing portion 70, first slider member 74, and centralizer arms 76 can remain relatively stationary (i.e., generally non-rotating). In addition or alternatively, either or both of the main shaft 90 and drive shaft 94 can be formed of multiple sections that may or may not be directly coupled together. For example, the main shaft 90 can include a lower main shaft portion 91, which may be coupled to or in abutment therewith. Further, various components of the borehole logging tool 10 can be concentrically arranged with the main shaft and/or drive shaft 90, 94 to provide for a compact tool design.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims.

What is claimed is:

1. A borehole logging tool, including:

a housing oriented along a longitudinal axis;

a centralizer assembly that positions the housing substantially at the center of the borehole, including a first slider member and a plurality of centralizer arms coupled thereto, the first slider member being slidable along the longitudinal axis to selectively control a radial extension of the plurality of centralizer arms; and a scanning head that rotates a plurality of scanning transducers axially within the borehole about the longitudinal axis, the scanning head further including a second slider member and a plurality of linkage arms coupling the second slider member to the plurality of scanning sensors, the second slider member being slidable along the longitudinal axis to selectively control a radial extension of the plurality of sensors.

2. The borehole logging tool of claim 1, wherein the plurality of linkage arms including a first set of linkage arms pivotally coupled to the second slider member and movable therewith, and a second set of linkage arms pivotally coupled to the housing.

3. The borehole logging tool of claim 1, further including an inductive coupling or slip ring adapted to communicate electrical current between the plurality of sensors and an external electrical coupler.

4. The borehole logging tool of claim 1, wherein the plurality of centralizer arms are radially extendable at a first diameter and the plurality of sensors are radially extendable at a second diameter, the second diameter being less than the first diameter based on at least one of a predetermined distance or a predetermined ratio.

5. The borehole logging tool of claim 1, wherein at least a portion of the centralizer arms include a grip portion adapted to grip an interior surface of the borehole.

6. The borehole logging tool of claim 1, further including a secondary centralizer assembly including a second plurality of centralizer arms that are spring biased outwards away from the longitudinal axis and adapted to inhibit pivoting of the borehole logging tool within the borehole.

7. The borehole logging tool of claim 1, further including a main shaft movable relative to the housing along the longitudinal axis and coupled to both of the first and second slider members.

8. The borehole logging tool of claim 7, further including a drive shaft rotatable together with the scanning head and arranged in a concentric relationship with the main shaft, the drive shaft being coupled to the main shaft to drive rotation of the scanning head.

9. The borehole logging tool of claim 7, wherein movement of the main shaft is driven by a motor or hydraulic actuator adapted to provide linear motion.

10. The borehole logging tool of claim 7, wherein movement of the main shaft along the longitudinal axis couples sliding movement of both of the first and second slider members to control the radial extension of the centralizer arms and the plurality of sensors substantially concurrently.

11. The borehole logging tool of claim 10, further including a damper disposed between the centralizer arms and the plurality of sensors.

12. A borehole logging tool, including:

a housing oriented along a longitudinal axis;

a centralizer assembly that positions the housing substantially at the center of the borehole, including a plurality of centralizer arms radially extendable outward from the longitudinal axis at a first diameter;

a scanning head that rotates a plurality of scanning sensors axially within the borehole about the longitudinal axis, the scanning head further including a plurality of linkage arms coupled to the plurality of scanning sensors such that the scanning sensors are radially extendable outward from the longitudinal axis at a second diameter; and an extension assembly adapted to substantially concurrently control the radial extension of the centralizer arms and the plurality of sensors.

13. The borehole logging tool of claim 12, wherein the second diameter is less than the first diameter based on at least one of a predetermined distance or a predetermined ratio.

14. The borehole logging tool of claim 12, wherein the extension assembly includes a first slider member coupled to the plurality of centralizer arms, a second slider member coupling the plurality of linkage arms to the plurality of scanning sensors, and a main shaft coupled to both of the first and second slider members and being movable relative to the housing along the longitudinal axis.

15. The borehole logging tool of claim 14, further including a drive shaft rotatable together with the scanning head and arranged in a concentric relationship with the main shaft, the drive shaft being coupled to the main shaft to drive rotation of the scanning head.

16. A borehole logging tool, including:

a centralizer assembly that positions a housing substantially at the center of the borehole, including a first slider member and a plurality of centralizer arms coupled thereto, the first slider member being slidable along a longitudinal axis to selectively control a radial extension of the plurality of centralizer arms;

a scanning head that rotates a plurality of scanning sensors axially within the borehole about the longitudinal axis, the scanning head further including a second slider member coupled to the plurality of scanning sensors, the second slider member being slidable along the longitudinal axis to selectively control a radial extension of the plurality of sensors; and a main shaft coupled to both of the first and second slider members and linearly movable along the longitudinal axis to drive sliding movement of both of the first and second slider members to simultaneously control the radial extension of the centralizer arms and the plurality of sensors.

17. The borehole logging tool of claim 16, further including a drive shaft rotatable together with the scanning head and arranged in a concentric relationship with the main shaft, the drive shaft being coupled to the main shaft to drive rotation of the scanning head.

18. The borehole logging tool of claim 16, further including a plurality of linkage arms coupling the second slider member to the plurality of scanning sensors, the plurality of linkage arms including a first set of linkage arms pivotally coupled to the second slider member and movable therewith, and a second set of linkage arms pivotally coupled to the housing.

19. The borehole logging tool of claim 16, wherein the plurality of centralizer arms are radially extendable at a first diameter and the plurality of sensors are radially extendable at a second diameter, the second diameter being less than the first diameter based on at least one of a predetermined distance or a predetermined ratio.

20. The borehole logging tool of claim 16, further including a damper disposed between the centralizer arms and the plurality of sensors.

* * * * *